United States Patent [19]

Sano

[11] Patent Number: 4,817,843

[45] Date of Patent: Apr. 4, 1989

[54] SUCTION DEVICE FOR YARN-THREADING

[75] Inventor: Takao Sano, Moriyama, Japan

[73] Assignee: Toray Industries, Inc., Tokyo, Japan

[21] Appl. No.: 127,928

[22] Filed: Dec. 1, 1987

[51] Int. Cl.[4] ..... B65H 51/16

[52] U.S. Cl. ..... 226/97; 28/271; 28/272; 57/279; 226/7; 226/91

[58] Field of Search ..... 226/95, 97, 7, 91, 92; 28/273, 271, 272; 57/279, 280, 350

[56] References Cited

U.S. PATENT DOCUMENTS

| | | | |
|---|---|---|---|
| 2,706,089 | 4/1955 | Griset, Jr. | 242/18 R |
| 2,870,971 | 1/1959 | Keith | 242/18 R |
| 2,883,475 | 4/1959 | Ridler et al. | 226/97 |
| 3,144,187 | 8/1964 | Naumann | 226/97 X |
| 3,397,437 | 8/1968 | NcNeill et al. | 28/289 |
| 3,423,000 | 1/1969 | Heinen | 226/97 |
| 3,452,910 | 7/1969 | Richter | 226/91 |
| 3,599,886 | 8/1969 | Koller | 242/35.5 R |
| 3,634,573 | 1/1972 | Wagner et al. | 226/97 X |
| 3,678,579 | 7/1972 | Slavik | 226/97 X |
| 3,690,530 | 9/1972 | Porter | 226/97 |
| 3,718,270 | 2/1973 | Parmeggiani et al. | 226/97 |
| 3,741,050 | 6/1973 | Coats et al. | 226/92 X |
| 3,970,231 | 7/1976 | Strutz et al. | 226/97 X |
| 3,986,325 | 10/1976 | Ritter | 57/280 |
| 4,073,421 | 2/1978 | Reufer | 226/97 |
| 4,181,247 | 1/1980 | Mc Fall | 226/97 |
| 4,329,840 | 5/1982 | Gasser et al. | 226/97 X |
| 4,332,130 | 6/1982 | Gasser et al. | 226/97 X |
| 4,351,492 | 9/1982 | Aoyama et al. | 226/91 X |
| 4,366,845 | 1/1983 | Simson | 226/97 X |
| 4,666,590 | 5/1987 | Sano et al. | 209/2 |

FOREIGN PATENT DOCUMENTS

| | | | |
|---|---|---|---|
| 0068177 | 1/1983 | European Pat. Off. . | |
| 146898 | 7/1985 | European Pat. Off. . | |
| 2524168 | 12/1976 | Fed. Rep. of Germany | 226/97 |
| 2722810 | 11/1978 | Fed. Rep. of Germany . | |
| 2239405 | 2/1975 | France . | |
| 51-28424 | 7/1976 | Japan . | |
| 438567 | 12/1967 | Switzerland . | |
| 512390 | 10/1971 | Switzerland . | |
| 571076 | 12/1975 | Switzerland . | |
| 638750 | 10/1983 | Switzerland . | |
| 1336524 | 11/1973 | United Kingdom . | |
| 1436545 | 5/1976 | United Kingdom . | |

*Primary Examiner*—John Petrakes

*Attorney, Agent, or Firm*—Lowe, Price, Leblanc, Becker & Shur

[57] ABSTRACT

A suction gun has a first injection nozzle and a second injection nozzle. The first and second injection nozzles inject pressurized water, thereby to draw a yarn with a suction force of the pressurized water. The second injection nozzle has a plurality of jets, respective axes of which intersect with each other at an intersection point. The intersection point is located in a position displaced by E, which is preferably in a range from 0.2 mm to 0.9 mm, from an axis of a through hole which is included in a pressurized liquid exhaust passage.

14 Claims, 7 Drawing Sheets

SUCTION DEVICE FOR YARN-THREADING

BACKGROUND OF THE INVENTION

1. Field of the Invention

The present invention relates to a suction device (hereinafter also referred to as "suction gun") for drawing and holding a yarn by pressurized liquid such as pressurized water, thereby to thread the yarn to a desired position.

2. Description of the Prior Art

It is well known in the art that a movable suction gun for drawing and holding a running yarn is employed in order to thread the yarn to a desired apparatus such as a godet roller, a bobbin of a winder or a yarn guide. In such a suction gun, pressurized air or pressurized liquid is employed as actuating fluid for drawing the yarn.

A preferable type of suction gun employing pressurized water as actuating fluid is disclosed in U.S. Pat. No. 4,666,590, which comprises first and second injection nozzles (suction nozzles). The first injection nozzle is provided oppositely to an inlet port of a pressurized liquid exhaust pipe, so that the yarn is thrust into the interior of the pressurized liquid exhaust pipe (yarn guide pipe) by injection force of the pressurized water injected from the first injection nozzle. An internal space of the pressurized liquid exhaust pipe defines a pressurized liquid exhaust passage. The second injection nozzle is provided in the upstream portion of the pressurized liquid exhaust passage, to obliquely inject pressurized water into the pressurized liquid exhaust passage. The yarn in the pressurized liquid exhaust passage is sucked and drawn by injection force of the pressurized water from the second injection nozzle, to be discharged from the suction gun with the pressurized water.

In such a two-stage injection type suction gun, an injection nozzle having a plurality of jets is employed as the second injection nozzle. In such prior art, the plurality of jets are so directed that the axes thereof intersect with each other at a single point on the axis of a through hole forming a part of the pressurized liquid exhaust passage, which is identical to an axis of the first injection nozzle. Therefore, the pressurized water introduced into the pressurized liquid exhaust pipe by the first injection nozzle is subjected to interference by the pressurized water from the second injection nozzle, and the yarn sucking force or tension in the suction gun is remarkably weakened. As the result, a large amount of pressurized water must be supplied in order to apply sufficient suction force to the yarn, whereby the cost required for the water supply is increased.

SUMMARY OF THE INVENTION

An object of the present invention is to provide a suction device for yarn-threading which can apply sufficient tension in suction to a yarn without requiring a large amount of pressurized liquid.

According to the present invention, a suction device for yarn-threading comprises a first injection nozzle having a first jet for injecting first a pressurized liquid; a pressurized liquid exhaust pipe having an inlet port facing the first jet with a predetermined yarn introducing space and defining a pressurized liquid exhaust passage by an internal space of the pressurized liquid exhaust pipe, the pressurized liquid exhaust passage including a through hole; and a second injection nozzle having a plurality of second jets around the through hole for obliquely injecting second pressurized liquid into the pressurized liquid exhaust passage; and the respective axes of the second jets intersect with each other at an intersection point displaced by a predetermined distance from an axis of the through hole.

According to a preferred embodiment of the present invention, the predetermined distance has a value within a range of from 0.2 mm to 0.9 mm.

According to the present invention, an injection force of the first pressurized liquid injected from the first injection nozzle does not interfere with that of the second pressurized liquid injected from the second injection nozzle, whereby suction force for the yarn is effectively increased. In other words, the amount of pressurized liquid required for obtaining a prescribed suction force or yarn tension in suction can be reduced.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
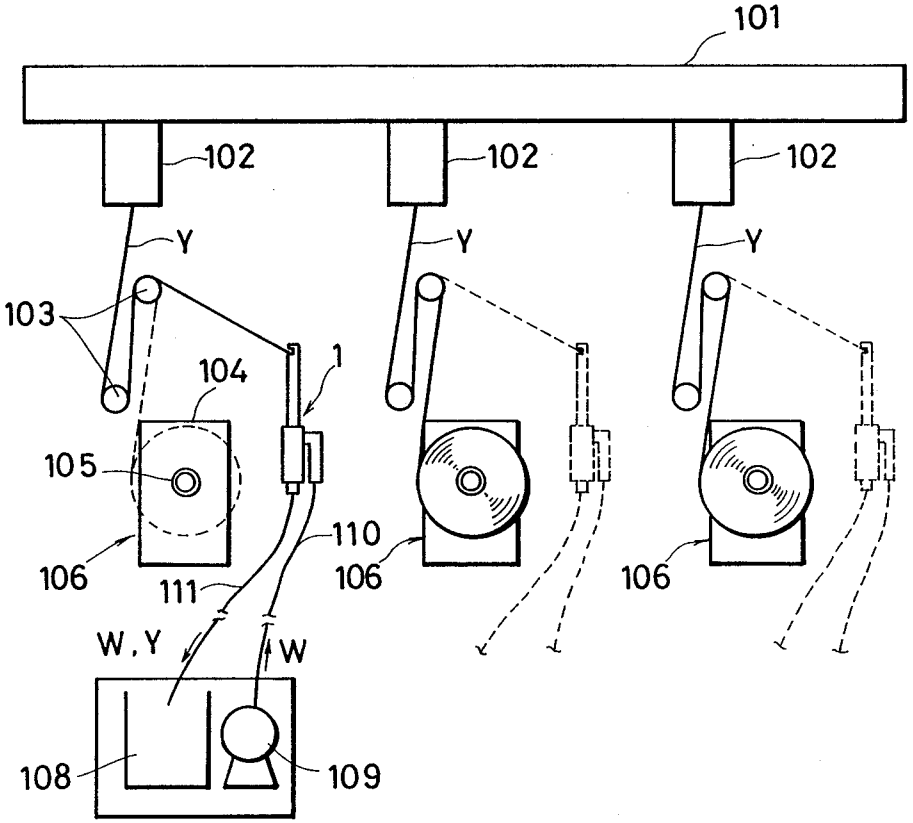
FIG. 1 is a diagram for illustrating the situation of applying a suction gun in yarn-threading.

FIG. 1 is an explanatory diagram illustrating a yarn-threading operation employing a suction gun 1. Before explaining the internal structure of the suction gun 1 according to an embodiment of the present invention, the situation in which the suction gun 1 is employed in the yarn-threading operation is discussed with reference to FIG. 1.

The suction gun 1 is employed in order to thread a synthetic yarn Y to a rotating bobbin 105, for example. The yarn Y extruded through spinning holes of spinnerets (not shown) provided in the lower portion of a spinning block 101 is derived from a plurality of ducts 102. The yarn Y running at a high speed is supplied to yarn winding device 106 through godet rollers 103. A plurality of such winding devices 106 are provided in correspondence to each of the ducts 102, and each of the winding devices 106 has a winder 104 and a bobbin 105 mounted on the same to rotate with a spindle (not shown) of the winder 104.

In order to thread one of the yarns Y to the corresponding winding device 106, pressurized water W is supplied to the suction gun 1 from a water pressurizing pump 109 through a hole 110. When the suction gun 1 is moved toward the bobbin 105 while picking-up and pulling the running yarn Y with suction force induced by an injection of the pressurized water W, the yarn Y captured by the suction gun 1 is caught and wound on the rotating bobbin 105. Thus, a yarn-threading operation is completed with respect to the first bobbin 105. Water discharged from the suction gun 1 and waste yarn are discharged to a waste yarn disposal device 108 through a hose 111.

In order to perform the yarn-threading operation of another yarn Y to another winding device 106, the suction gun 1 is manually moved to perform an operation similar to the one described above.

The suction gun 1 of this embodiment typically is a suction device which employs pressurized water as pressurized liquid. Details of the yarn disposal device 108 are disclosed in U.S. Pat. No. 4,666,590, for example.

Figure 2:
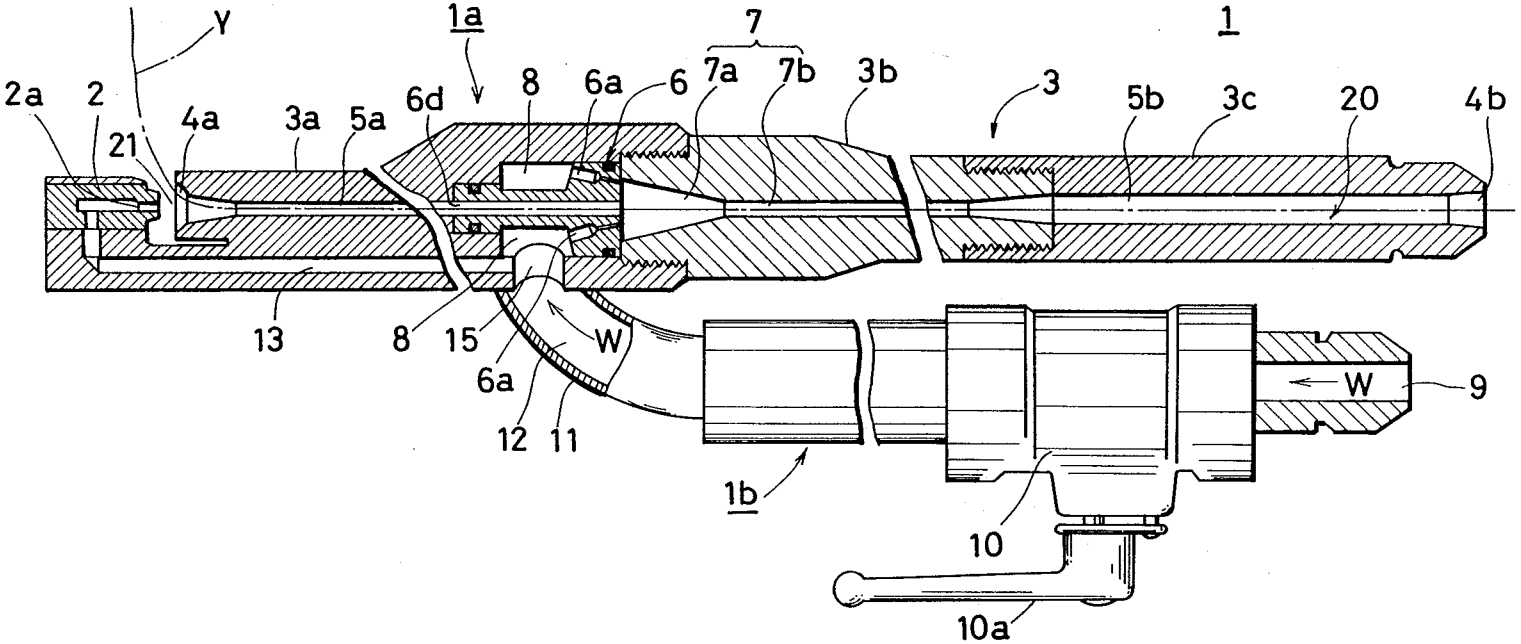
FIG. 2 is a partially fragmented sectional view showing a suction gun according to a preferred embodiment of the present invention.
Figure 3:
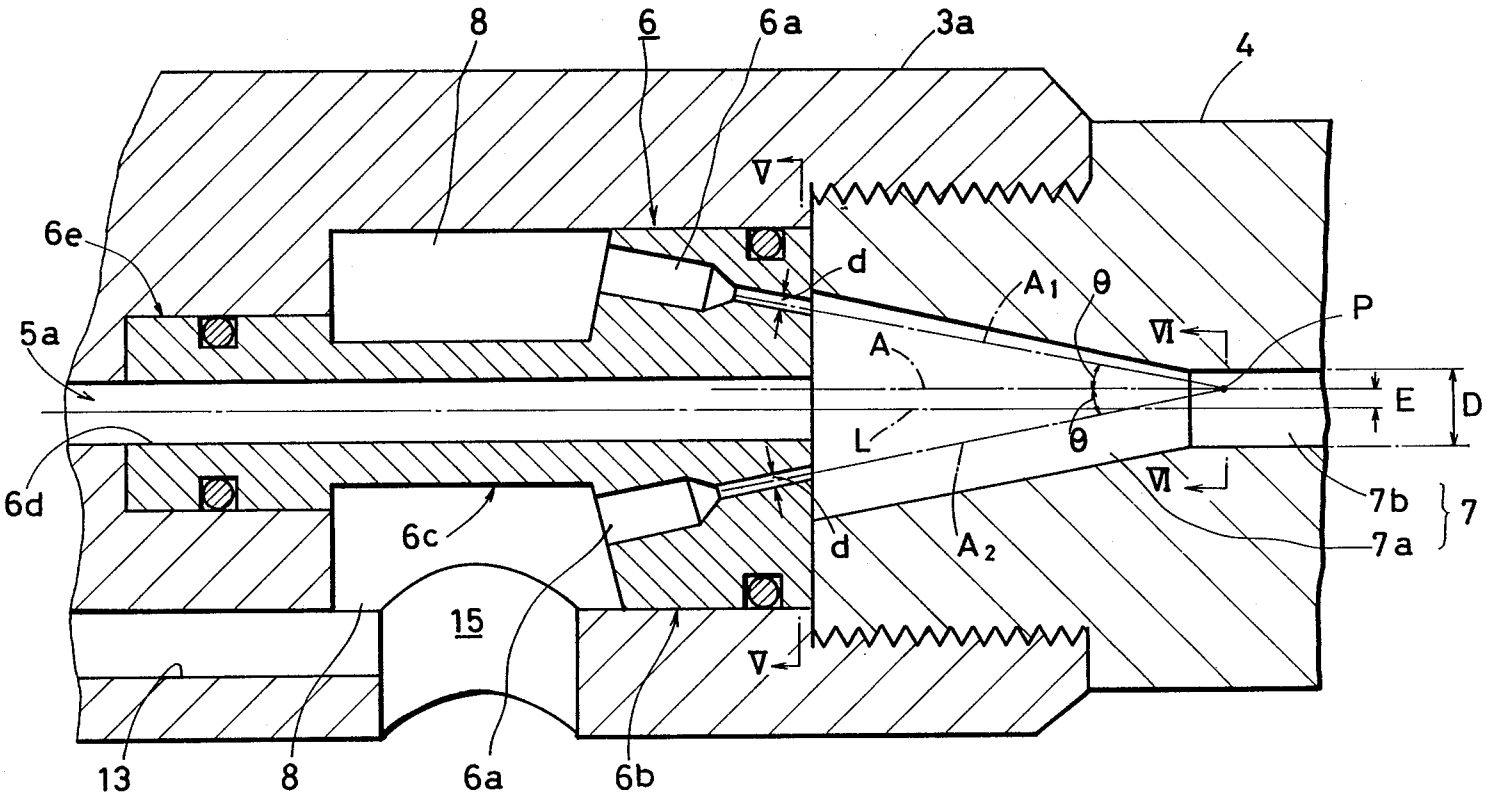
FIG. 3 is a partially enlarged view of the suction gun shown in FIG. 2.

FIG. 2 is a partially fragmented sectional view of the suction gun 1, and FIG. 3 is a partially enlarged view thereof. The suction gun 1 comprises a substantially straight-tubular gun body 1*a* and a pressurized water introducing pipe 1*b* extending from a side wall of the gun body 1*a*. The pressurized water introducing pipe 1*b* receives the pressurized water W supplied from the hose 110 of FIG. 1 from a pressurized water inlet port 9 provided in an end thereof. A valve 10 is provided in a part of the pressurized water introducing pipe 1*b*, to be opened/closed by operation of a valve handle 10*a*.

The other end of the pressurized water introducing pipe 1*b* is fixed to the side wall of the gun body 1*a*. The pressurized water W is introduced into the interior of the gun body 1*a* through a pressurized water inlet hole 15, circular in section, which is provided on the side wall of the gun body 1*a*. A part of the pressurized water W (first pressurized water) is guided toward the forward end of the gun body 1*a* through a pressurized water feed path 13 which is provided in the interior of the body 1*a*. A first injection nozzle 2 having a first jet 2*a* is mounted on the forward end of the body 1*a*. The pressurized water W is fed to the first injection nozzle 2, to be injected from the first jet 2*a* rightwardly in FIG. 2.

A major part of the body 1*a* is formed by a pressurized liquid exhaust pipe 3 yarn guide pipe. The pressurized liquid exhaust pipe 3 is formed by sequentially screwing first to third tubular members 3*a* to 3*c*. A pressurized liquid exhaust passage 20 is defined and formed by an internal space of the pressurized liquid exhaust pipe 3, to substantially linearly extend from an end of the pressurized liquid exhaust pipe 3 to the other end thereof.

An inlet port 4*a* of the first tubular member 3*a* is positioned to face the first jet 2*a* with a yarn introducing space 21. Thus, the pressurized liquid from th first jet 2*a* is injected into the pressurized liquid exhaust passage 20. This pressurized liquid exhaust passage 20 is formed by respective internal passages 5*a*, 7 and 5*b* of the first to third tubular members 3*a* to 3*c* and a through hole 6*d* formed in a second injection nozzle 6 as hereinafter described.

In a yarn-threading operation, the suction gun 1 is manually moved to introduce the yarn Y into a yarn introducing space 21. The yarn Y is thrust into the pressurized liquid exhaust passage 20 with the pressurized water injected from the first jet 2*a* by the injection force of the pressurized water, whereby the suction gun 1 captures the yarn Y. The pressurized water and the yarn Y pass through the pressurized liquid exhaust passage 20, to be discharged through an outlet port 4*b* into the hose 111 shown in FIG. 1.

Figure 4:
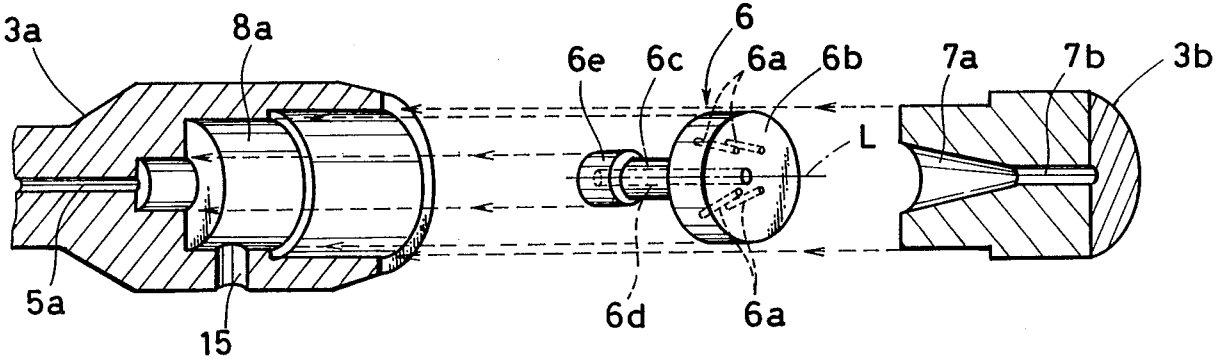
FIG. 4 is a diagram showing a positional relation between a second injection nozzle and a pressurized water chamber.

The second injection nozzle 6 is assembled in a predetermined position of the pressurized liquid exhaust passage 20. As shown in FIG. 4, the second injection nozzle 6 has a shank 6*c*, a nozzle portion 6*b* and a sealing part 6*e*, all of which are integrated with each other. In the nozzle portion 6*b*, four second jets 6*a* are formed. The through hole 6*d* is formed through the sealing part 6*e*, the shank 6*c* and the nozzle portion 6*b*. The second jets 6*a* are positioned to surround the through hole 6*d*. Although the sectional shape of the through hole 6*d* is arbitrary, it is preferred to have it be a circle. As hereinafter described, an axis L of the through hole 6*d* has an important meaning in the embodiment, and it is defined by a line passing through the central point of the circle, when the sectional shape is the circle. When the sectional shape is an ellipse, the axis L is defined by a line passing through a point at which a major axis and a minor axis defined on a plane including the ellipse are crossing each other. Further, when a polygon is employed as the sectional shape, the axis L is defined by a line passing through a point at which each of diagonal lines of the polygon are crossing each other.

As shown in FIG. 4, an internal space 8*a* which opens to the internal passage 5*a* is defined in the interior of the first tubular member 3*a*. The diameter of the internal space 8*a* is larger than that of the shank 6*c* and substantially identical to the diameter of the nozzle portion 6*b*. Thus, an annular pressurized water chamber 8 shown in FIG. 3 is formed by inserting the second injection nozzle 6 into the internal space 8*a*. The pressurized water chamber 8 opens to the pressurized water inlet hole 15. Therefore, within the pressurized water externally supplied through the pressurized water inlet hole 15, a part (hereinafter referred to as the second pressurized water) not being supplied to the first injection nozzle 2 flows into the pressurized water chamber 8. The pressurized water in the pressurized water chamber 8 is obliquely injected into an internal passage 7 through the second jets 6*a*. The internal passage 7 is formed by combination of a truncated-conical injection chamber 7*a* existing in the vicinity of opening positions of the second jets 6*a* and a tubular passage 7*b* extending from the injection chamber 7*a*. By injection force of the pressurized water injected from the second jets 6*a*, further tension in suction is applied to the yarn Y in a direction toward the outlet port 4*b* shown in FIG. 2. Thus, a larger suction force acts on the yarn Y. The pressurized water injected from the second jets 6*a* is also discharged from the outlet port 4*b*.

The arrangement for directing of the second jets 6*a* corresponding to a key feature of the present invention will now be described. The direction of the second jets 6*a* is determined such that axes $A_1$ to $A_4$ thereof (FIG. 3 shows only $A_1$ and $A_2$) intersect with each other at an intersection point P, which is located in a position displced by a presecribed distance (hereinafter referred to as the "offset distance") E from an axis L of the through hole 6*d*. The intersection point P is located in the internal passage 7, and preferably, it is formed in the tubular passage 7*b*. In this embodiment, the first jet 2*a* the internal passages 5*a*, 7 and 5*b* forming the pressurized liquid exhaust passage 20; and the through hole 6*d* are all coaxial with each other. At least, it is preferred that the axis of the first jet 2*a* coincides with the axis L of the through hole 6*d*.

Assuming that the symbol A represents a straight line passing through the intersection point P and parallel to the axis L of the through hole 6d, the straight line A is at the same angle $\theta$ with respect to the axes $A_1$ to $A_4$.

The inclining angle $\theta$ of the axes $A_1$ to $A_4$ of the second jets 6a from the line A (accordingly, from the axis L) may be arbitrary decided. Preferably, the inclining angle $\theta$ is in the range 3° to 20°, and most preferably, it is in the range 5° to 15°. The diameter of the pressurized liquid exhaust passage 20 may be decided in response to the sectional size of the yarn Y to be threaded. It is preferable that the diameters of the internal passage 5a and the through hole 6d be selected in the range 1.5 to 8.0 mm, that of the tubular passage 7b from 2.0 to 15.0 mm, and that of the tubular passage 5b from 2.5 to 20.0 mm.

Figure 5:
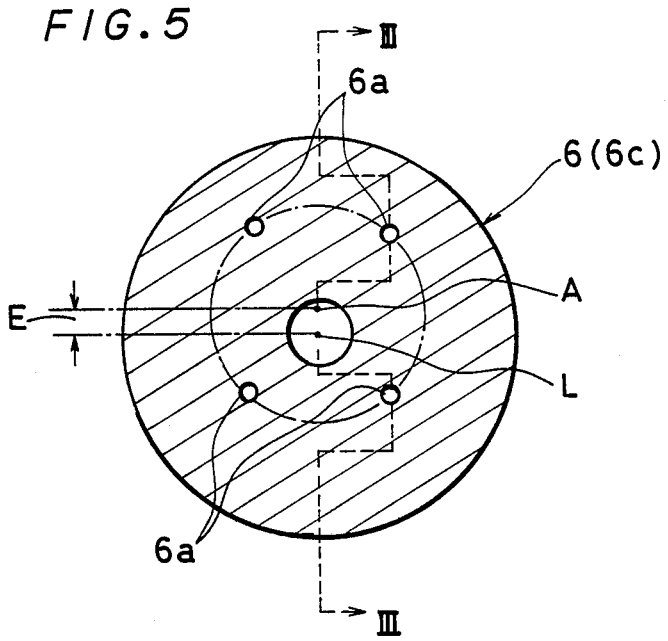
FIGS. 5 and 6 are sectional end views taken along lines V—V and VI—VI in FIG. 3, respectively.

FIG. 5 is a sectional end view taken along the line V—V in FIG. 3, in which respective opening portions of the second jets 6a are arranged at isometric intervals (360÷4=90° in this embodiment) about the straight line A. FIG. 3 corresponds to a sectional view taken along the line III—III in FIG. 5.

Figure 6:
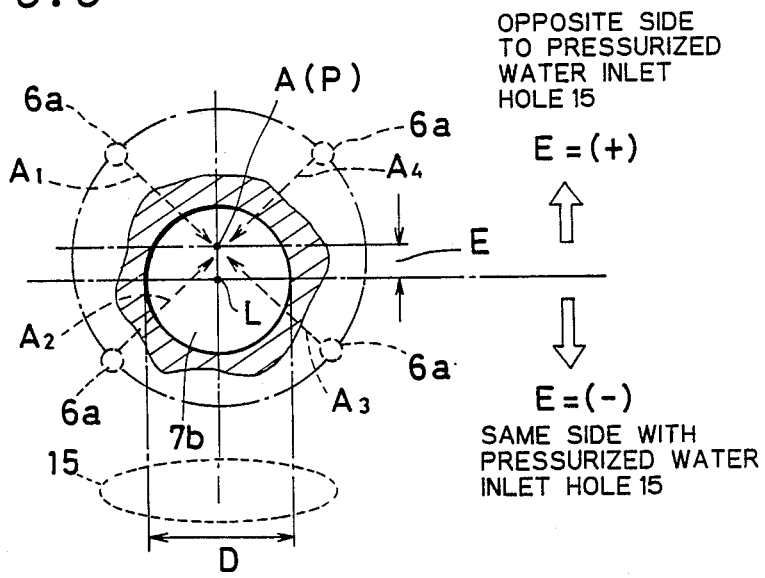

FIG. 6 illustrates a partially enlarged sectional view taken along the line VI—VI in FIG. 3. As hereinabove described, the intersection point P is located in the tubular passage 7b. When pressurized water is injected along the axis $A_1$ to $A_4$ of the second jets 6a, the pressurized water flows into the tubular passage 7b toward the intersection point P.

According to such a structure, the intersection point P is set in a position displaced by the offset distance E from the axis L of the through hole 6d, whereby the first pressurized water introduced into the pressurized liquid exhaust passage 20 with the yarn Y by the first injection nozzle 2 which is coaxial to the through hole 6d is not subjected to interference by the second pressurized water from the second injection nozzle 6. Therefore, the force of the second pressurized water from the second injection nozzle 6 is superposed on force of the first pressurized water from the first injection nozzle 2 in the tubular passage 7b, whereby the suction force applied to the yarn Y is remarkably increased.

By setting the offset distance E at a specific value, the pressurized water sufficiently fills up the tubular passage 7b, and the yarn Y smoothly flows through the tubular passage 7b and the internal passage 5b (FIG. 2) by the pressurized water to provide a larger suction force.

Description is now provided of the results of experiments for measuring the difference in yarn suction force when a specific value was chosen for the offset distance E and in a case where the offset distance E=0. In the following embodiments, respective symbols indicate the following amounts:

$d_0$: diameter of the first jet 2a d: diameter of forward end portions of the second jets 6a (FIG. 3)

N: number of the second jets 6a

$\theta$: angle of intersection of the axes $A_1$ to $A_4$ of the second jets 6a and the straight line A (FIG. 3)

D: inner diameter of the tubular passage 7b (FIGS. 3 and 6)

E: offset distance (FIG. 6). An offset toward the same side as the pressurized water inlet hole 15 of FIG. 2 is expressed by the sign "−" and an offset to the opposite side of the pressurized water inlet hole 15 with respect to the axis L is expressed by the sign "+".

V: suction speed for the yarn $P_r$: pressure of the pressurized water

A. FIRST TEST

Conditions

| | |
|---|---|
| $d_0$ = 1.0 mm | d = 0.6 mm |
| N = 4 | $\theta$ = 10° |
| D = 3.5 mm | V = 1500 m/min. |
| $P_r$ = 120 Kg/cm²G and 70 Kg/cm²G | |
| yarn Y = nylon yarn of 70 deniers and of 12 filaments | |
| −1.2 mm ≦ E ≦ +1.2 mm | |

Result of Measurements

Figure 7:
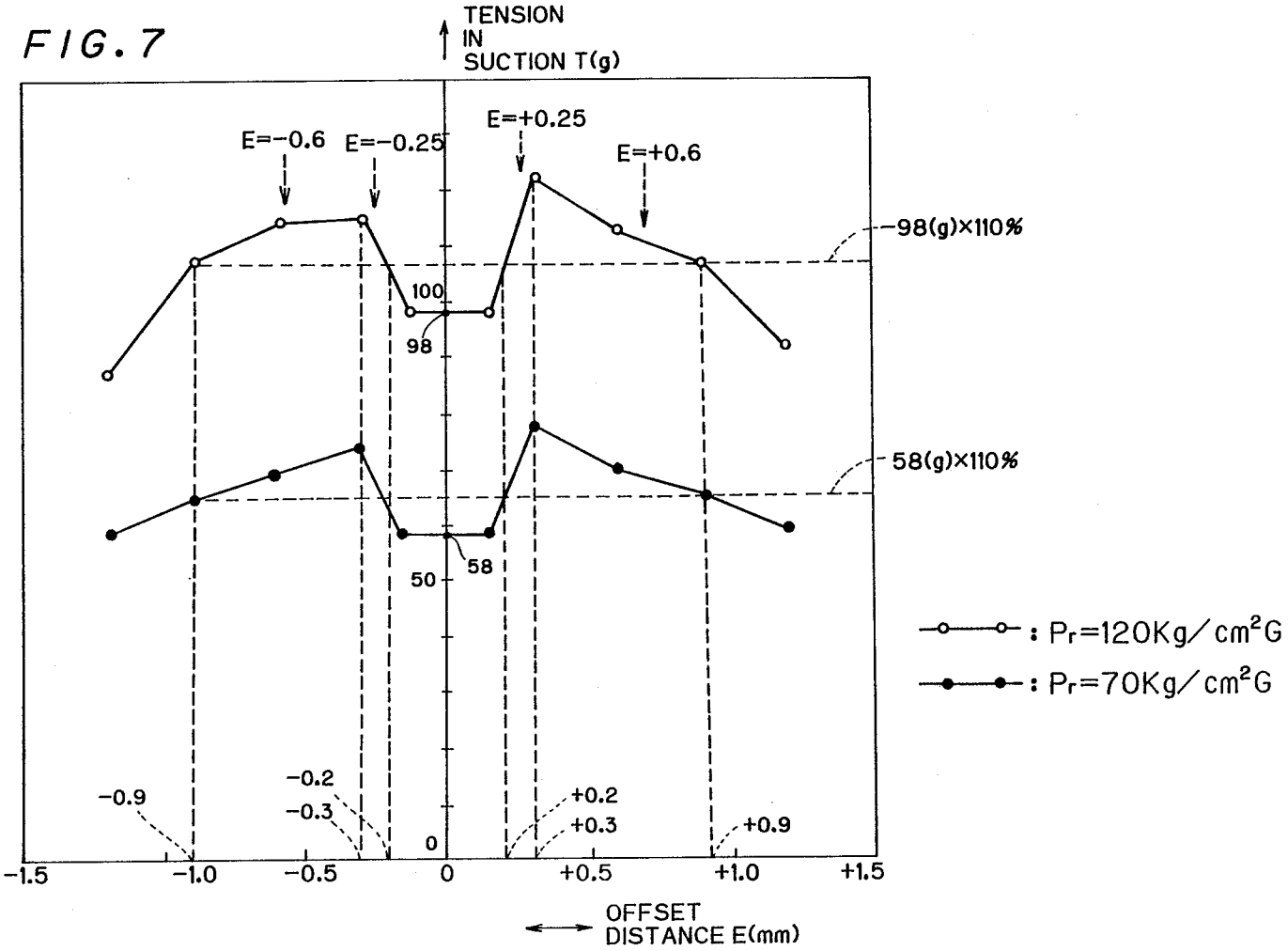
FIG. 7 is a graph showing data obtained as the result of an experiment in a first test.

FIG. 7 shows the result of measurements of this case, as a relationship between the offset distance E and yarn suction force (tension suction) T (gram).

As seen from FIG. 7, the tension in suction T is considerably increased as the absolute value of the offset distance E is increased from 0 mm. Within the measured points, the maximum values in each side of E>0 and E<0 are attained when |E|=0.3 mm. These maximum values are 120 to 130% of the tension value in the case of E=0 mm. Conversely, the tension in suction T is decreased if the absolute value of the offset distance E is excessively increased from the value 0.3 mm. It may be considered that in this case the effective composition of injection forces by the first and second injection nozzles 2 and 6 is lost.

Through analysis of the graphs of FIG. 7 in further detail, the following facts are found:

(a) The change of tension force in suction T, with respect to the offset distance E, does not depend on the value of the pressurized water pressure $P_r$. Hence, it is possible to set an optimum offset distance E without regard to the value of the pressurized water pressure $P_r$.

(b) A high tension value in excess of 110% of the value T in the case of E=0 mm is obtained within a range of $$0.2\text{ mm} \leqq |E| \leqq 0.9\text{ mm, and}$$

within this range, an especially preferable range is:

$$0.25\text{ mm} \leqq |E| \leqq 0.6\text{ mm}$$

B. SECOND TEST

In this test, measurements were made at various values E as to the amounts of the pressurized water W needed for obtaining tension in suction T=0.5 g/denier. The structure of the suction gun 1 was identical to that of the first test. The yarn members Y were prepared as polyethylene terephthalate yarn of 75 deniers and 36 filaments, to simultaneously draw eight yarns at the speed of V=5000 m/min. The value of the water pressure $P_r$ was employed as the parameter indicating the amount of supply of the pressurized water, whereby the results as shown in Table 1 were obtained.

TABLE 1

| E (mm) | $P_r$ (Kg/mmG) |
|---|---|
| 0 | 210 |
| 0.2 | 180 |
| 0.3 | 160 |
| 0.9 | 180 |

It is understood from Table 1 that tension in suction identical to that in the case of E=0 is obtained with the water pressure not more than 90% of that in the case of E=0 in the range of:

$$0.2 \leqq |E| \leqq 0.9$$

Since the water pressure $P_r$ is proportional to the square root of amount of supply of the pressurized water, a similar conclusion can be obtained with respect to the amount of supply of the pressurized water.

C. THIRD TEST

Figure 8:
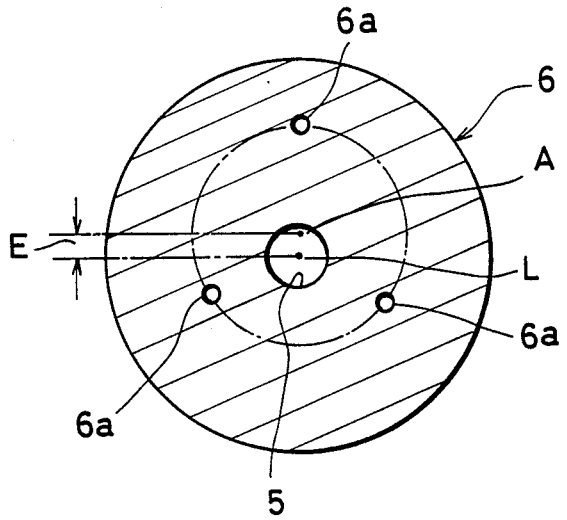
FIG. 8 is a diagram showing a second injection nozzle employed in another test.

The suction gun 1 was prepared to have three nozzles 6a, i.e., N=3 (refer to FIG. 8). A nylon yarn of 70 deniers and of 24 filaments was employed with $P_r$=100 Kg/cm$^2$G. The remaining conditions were identical to those of the first test.

With respect to E=0 mm and E=+0.3 mm, the results shown in Table 2 were obtained.

TABLE 2

| E (mm) | T (g) |
|---|---|
| 0 | 100 |
| +0.3 | 150 |

As seen from Table 2, the tension in suction T in the case of E=+0.3 mm was increased by 50% over the case of E=0 mm. In an experiment comparing the required amounts of water supply for obtaining the same tension with the suction speed V of 4500 m/min., the test result showed that the required amount of water supply in the case of an offset distance E=+0.3 mm can be reduced by about 15% as compared with that in the case where E=0 mm.

It is understood from the aforementioned tests that it is extremely effective to set the offset distance E at a specific value excluding zero under various conditions. Preferably, $$0.2 \text{ mm} \leqq |E| \leqq 0.9 \text{ mm},$$

and the optimum value is E=+0.3 mm or in proximity thereto.

In the aforementioned tests, the straight line A was at the same angle $\theta$ with respect to the axes $A_1$ to $A_4$ and the second jets 6a were arranged at isometric angle intervals, and such a condition gives uniform tension to the yarn Y.

According to the present invention as hereinabove described, the intersection point of the axes of the respective jets included in the second injection nozzle is best displaced by a predetermined distance from the axis of the through hole in the pressurized liquid exhaust pipe, thereby to avoid interference between the pressurized liquid introduced into the exhaust pipe by the first injection nozzle and that introduced by the second injection nozzle is an intermediate portion of the exhaust passage. In the exhaust passage, therefore, the force of the pressurized liquid from the second injection nozzle is superposed on the force of the pressurized liquid introduced by the first injection nozzle. Consequently, the total suction force applied to the yarn can be increased significantly without increasing the amount of supply of the pressurized liquid.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A suction device for picking-up and pulling a yarn by using an injection force, provided by a controlled flow of pressurized liquid to thread said yarn to a desired position, said suction device comprising:

a first injection nozzle providing a first jet for injecting a first flow of pressurized liquid;

a pressurized liquid exhaust pipe having an inlet port facing said first jet with a predetermined yarn introducing space and a pressurized liquid exhaust passage formed by an internal space of said pressurized liquid exhaust pipe, said pressurized liquid exhaust passage including a through hole; and a second injection nozzle providing a plurality of second jets around said through hole for obliquely injecting a second flow of pressurized liquid into said pressurized liquid passage, the respective axes of said second jets intersecting with each other at an intersection point displaced by a predetermined distance from an axis of said first jet, said axis of said first jet being identical to an axis of said through hole.

2. A suction device in accordance with claim 1, wherein:

said predetermined distance has a value within a range from 0.2 mm to 0.9 mm.

3. A suction device in accordance with claim 2, wherein:

said pressurized liquid exhaust passage has a truncated-conical injection chamber provided in the vicinity of opening positions of said second jets and a tubular passage extending from said truncated-conical injection chamber, and said intersection point is located in the interior of said tubular passage.

4. A suction device in accordance with claim 2, wherein:

respective ones of said second jets are so arranged that respective ones of said axes of said second jets are arranged at isometric angle intervals about said straight line.

5. A suction device in accordance with claim 4, wherein:

there are three of said second jets, arranged symmetrically about said straight line.

6. A suction device in accordance with claim 4, wherein:

there are four of said second jets, arranged symmetrically about said straight line.

7. A suction device in accordance with claim 6, wherein:

said predetermined distance is in the range 0.25 mm to 0.6 mm.

8. A suction device in accordance with claim 7, wherein:

said angle is in the range 3° to 20°.

9. A suction device in accordance with claim 7, wherein:

said pressurized liquid exhaust passage has a truncated-conical injection chamber provided in the vicinity of opening positions of said second jets and a tubular passage extending from said truncated-conical injection chamber, and said intersection point is located in the interior of said tubular passage.

10. A suction device in accordance with claim 4, wherein:

each of the second jets is inclined at an equal predetermined angle with respect to said straight line.

11. A suction device in accordance with claim 10, wherein:

said angle is in the range 3° to 20°.

12. A suction device in accordance with claim 11, wherein:

said angle is in the range 5° to 15°.

13. A suction device in accordance with claim 12, wherein:

there are three of said second jets, arranged symmetrically about said straight line.

14. A suction device in accordance with claim 12, wherein:

there are four of said second jets, arranged symmetrically about said straight line.

* * * * *